US007713142B2

(12) United States Patent
Hoffman et al.

(10) Patent No.: US 7,713,142 B2
(45) **Date of Patent: *May 11, 2010**

(54) GOLF CLUB HEAD WEIGHT REINFORCEMENT

(75) Inventors: Joseph Henry Hoffman, Carlsbad, CA (US); Kraig Alan Willett, Fallbrook, CA (US); Todd P. Beach, San Diego, CA (US); John F. Lorentzen, El Cajon, CA (US); Allan C. Saliba, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/011,257

(22) Filed: Jan. 25, 2008

(65) Prior Publication Data

US 2008/0261717 A1 Oct. 23, 2008

Related U.S. Application Data

(63) Continuation of application No. 11/065,772, filed on Feb. 24, 2005, now Pat. No. 7,419,441, which is a continuation-in-part of application No. 10/785,692, filed on Feb. 23, 2004, now Pat. No. 7,166,040, which is a continuation-in-part of application No. 10/290,817, filed on Nov. 8, 2002, now Pat. No. 6,773,360.

(51) Int. Cl.
*A63B 53/04* (2006.01)

(52) U.S. Cl. ..... 473/334; 473/335; 473/336; 473/345; 473/346

(58) Field of Classification Search ..... 473/324–350, 473/290–292
See application file for complete search history.

(56) References Cited

U.S. PATENT DOCUMENTS

| | | | |
|---|---|---|---|
| 1,133,129 | A | 3/1915 | Govan |
| 1,518,316 | A | 12/1924 | Ellingham |
| 1,526,538 | A | 2/1925 | Scott |
| 1,538,312 | A | 5/1925 | Beat |
| 1,592,463 | A | 7/1926 | Marker |
| 1,658,581 | A | 2/1928 | Tobia |

(Continued)

FOREIGN PATENT DOCUMENTS

| | | |
|---|---|---|
| DE | 9012884 | 9/1990 |

(Continued)

OTHER PUBLICATIONS

Jackson, Jeff, "The Modern Guide to Golf Clubmaking", Ohio: Dynacraft Golf Products, Inc., copyright 1994, p. 237.

(Continued)

*Primary Examiner*—Sebastiano Passaniti
(74) *Attorney, Agent, or Firm*—Klarquist Sparkman, LLP

(57) ABSTRACT

A wood-type golf club head is described that includes a body including one or more walls defining an interior cavity and multiple weight ports formed in the body. At least one weight is configured to be retained at least partially within at least one of the weight ports. One or more fins or ribs are secured to each of the weight ports and to another structural member of the golf club head.

22 Claims, 9 Drawing Sheets

U.S. PATENT DOCUMENTS 1,704,119 A 3/1929 Buhrke
1,970,409 A 8/1934 Wiedemann
D107,007 S 11/1937 Cashmore
2,214,356 A 9/1940 Wettlaufer
2,225,930 A 12/1940 Sexton
2,360,364 A 10/1944 Reach
2,460,435 A 2/1949 Schaffer
2,681,523 A 6/1954 Sellers
3,064,980 A 11/1962 Steiner
3,466,047 A 9/1969 Rodia et al.
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,897,066 A 7/1975 Belmont
3,976,299 A 8/1976 Lawrence et al.
3,979,122 A 9/1976 Belmont
3,979,123 A 9/1976 Belmont
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,214,754 A 7/1980 Zebelean
4,262,562 A 4/1981 MacNeill
D259,698 S 6/1981 MacNeill
4,340,229 A 7/1982 Stuff, Jr.
4,411,430 A 10/1983 Dian
4,423,874 A 1/1984 Stuff, Jr.
4,438,931 A 3/1984 Motomiya
4,530,505 A 7/1985 Stuff
D284,346 S 6/1986 Masters
4,602,787 A 7/1986 Sugioka et al.
4,607,846 A 8/1986 Perkins
4,730,830 A 3/1988 Tilley
4,736,093 A 4/1988 Braly
4,754,977 A 7/1988 Sahm
4,795,159 A 1/1989 Nagamoto
4,867,457 A 9/1989 Lowe
4,867,458 A 9/1989 Sumikawa et al.
4,869,507 A 9/1989 Sahm
4,895,371 A 1/1990 Bushner
4,962,932 A 10/1990 Anderson
4,994,515 A 2/1991 Washiyama et al.
5,000,454 A * 3/1991 Soda ..... 473/346
5,039,267 A 8/1991 Wollar
5,050,879 A 9/1991 Sun et al.
5,058,895 A 10/1991 Igarashi
5,244,210 A 9/1993 Au
5,253,869 A 10/1993 Dingle et al.
D343,558 S 1/1994 Latraverse et al.
5,316,305 A 5/1994 McCabe
5,320,005 A 6/1994 Hsiao
5,328,176 A 7/1994 Lo
5,385,348 A 1/1995 Wargo
5,410,798 A 5/1995 Lo
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,451,058 A * 9/1995 Price et al. ..... 473/340
5,518,243 A 5/1996 Redman
5,533,730 A 7/1996 Ruvang
5,571,053 A 11/1996 Lane
5,624,331 A 4/1997 Lo et al.
5,629,475 A 5/1997 Chastonay
5,632,694 A 5/1997 Lee
5,669,827 A 9/1997 Nagamoto
5,683,309 A 11/1997 Reimers
5,709,613 A 1/1998 Sheraw
5,709,615 A * 1/1998 Liang ..... 473/324
5,718,641 A 2/1998 Lin
D392,526 S 3/1998 Nicely
5,746,664 A 5/1998 Reynolds, Jr.
5,755,627 A 5/1998 Yamazaki et al.
5,769,737 A 6/1998 Holladay et al.
5,776,011 A 7/1998 Su et al.
RE35,955 E 11/1998 Lu
D409,463 S 5/1999 McMullin
5,908,356 A 6/1999 Nagamoto
5,911,638 A 6/1999 Parente et al.
D412,547 S 8/1999 Fong
5,935,019 A 8/1999 Yamamoto
5,941,782 A 8/1999 Cook
5,947,840 A 9/1999 Ryan
5,967,905 A 10/1999 Nakahara et al.
5,997,415 A 12/1999 Wood
6,015,354 A 1/2000 Ahn et al.
6,019,686 A 2/2000 Gray
6,023,891 A 2/2000 Robertson et al.
6,032,677 A 3/2000 Blechman et al.
6,056,649 A 5/2000 Imai
6,089,994 A 7/2000 Sun
6,149,533 A 11/2000 Finn
6,162,132 A 12/2000 Yoneyama
6,162,133 A 12/2000 Peterson
6,238,303 B1 5/2001 Fite
6,270,422 B1 8/2001 Fisher
6,277,032 B1 8/2001 Smith
6,296,579 B1 10/2001 Robinson
6,299,547 B1 10/2001 Kosmatka
6,309,311 B1 * 10/2001 Lu ..... 473/332
6,334,817 B1 1/2002 Ezawa et al.
6,348,014 B1 2/2002 Chiu
6,379,265 B1 4/2002 Hirakawa et al.
6,383,090 B1 5/2002 O'Doherty et al.
6,390,933 B1 5/2002 Galloway et al.
6,409,612 B1 6/2002 Evans et al.
6,436,142 B1 8/2002 Paes et al.
6,440,009 B1 8/2002 Guibaud et al.
6,454,665 B2 * 9/2002 Antonious ..... 473/346
6,514,154 B1 2/2003 Finn
6,524,197 B2 2/2003 Boone
6,527,649 B1 3/2003 Neher et al.
6,530,848 B2 3/2003 Gillig
6,565,448 B2 5/2003 Cameron et al.
6,569,040 B2 5/2003 Bradstock
6,641,487 B1 11/2003 Hamburger
6,669,571 B1 12/2003 Cameron et al.
6,739,983 B2 5/2004 Helmstetter et al.
6,757,572 B1 6/2004 Forest
6,773,360 B2 8/2004 Willett et al.
6,860,818 B2 3/2005 Mahaffey et al.
6,974,373 B2 12/2005 Kriesel
6,974,393 B2 12/2005 Caldwell et al.
6,988,960 B2 1/2006 Mahaffey et al.
6,991,558 B2 1/2006 Beach et al.
7,140,974 B2 11/2006 Chao et al.
7,153,220 B2 12/2006 Lo
7,163,468 B2 1/2007 Gibbs et al.
7,166,040 B2 1/2007 Hoffman et al.
7,169,060 B2 1/2007 Stevens et al.
7,186,190 B1 3/2007 Beach et al.
7,223,180 B2 5/2007 Willett et al.
7,247,104 B2 * 7/2007 Poynor ..... 473/329
7,419,441 B2 * 9/2008 Hoffman et al. ..... 473/334
7,530,904 B2 * 5/2009 Beach et al. ..... 473/337
2001/0049310 A1 12/2001 Cheng et al.

| | | | |
|---|---|---|---|
| 2002/0022535 | A1 | 2/2002 | Takeda |
| 2002/0032075 | A1 | 3/2002 | Vatsvog |
| 2002/0072434 | A1 | 6/2002 | Yabu |
| 2002/0137576 | A1 | 9/2002 | Dammen |
| 2002/0160854 | A1 | 10/2002 | Beach et al. |
| 2003/0130059 | A1 | 7/2003 | Billings |
| 2004/0087388 | A1 | 5/2004 | Beach et al. |
| 2004/0242343 | A1 | 12/2004 | Chao |
| 2006/0058112 | A1 | 3/2006 | Haralason et al. |

FOREIGN PATENT DOCUMENTS

| | | |
|---|---|---|
| EP | 1001175 | 5/2000 |
| GB | 194823 | 12/1921 |
| JP | 05-317465 | 5/1992 |
| JP | 06-304271 | 4/1993 |
| JP | 06-126004 | 5/1994 |
| JP | 09-028844 | 2/1997 |
| JP | 09-327534 | 12/1997 |
| JP | 9308717 | 12/1997 |
| JP | 2773009 | 7/1998 |
| JP | 10-234902 | 8/1998 |
| JP | 10277187 | 10/1998 |
| JP | 2004 222911 | 8/2004 |
| WO | WO 8802642 | 4/1998 |
| WO | WO 01/66199 | 9/2001 |
| WO | WO 02062501 | 8/2002 |
| WO | WO 03/061773 | 7/2003 |

OTHER PUBLICATIONS

Office Action from the U.S. Patent and Trademark Office in co-pending U.S. Appl. No. 11/669,916, dated Nov. 25, 2009.

Office Action from the U.S. Patent and Trademark Office in co-pending U.S. Appl. No. 11/669,910, dated Nov. 24, 2009.

Office Action from the U.S. Patent and Trademark Office in co-pending U.S. Appl. No. 11/669,927, dated Dec. 7, 2009.

* cited by examiner

GOLF CLUB HEAD WEIGHT REINFORCEMENT

CROSS REFERENCE TO RELATED APPLICATION

The present application is a continuation of U.S. patent application Ser. No. 11/065,772, filed Feb. 24, 2005, now U.S. Pat. No. 7,419,441 which is a continuation-in-part of U.S. patent application Ser. No. 10/785,692, filed Feb. 23, 2004, now U.S. Pat. No. 7,166,040, which is a continuation-in-part of U.S. patent application Ser. No. 10/290,817, filed Nov. 8, 2002, now U.S. Pat. No. 6,773,360. These applications are incorporated herein by this reference.

FIELD

The present application is directed to golf club heads, and particularly to stiffening or reinforcing members in wood-type golf club heads.

BACKGROUND

The center of gravity of a golf club head is one critical parameter of the club's performance. Upon impact, it greatly affects launch angle and flight trajectory of a struck golf ball. Thus, much effort has been made over positioning the center of gravity of golf club heads. To that end, current driver and fairway wood golf club heads are typically formed of light-weight, yet durable materials, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be later added to the interior of the club head through the club head's hosel opening to obtain a final desired weight of the club head. To achieve significant localized mass, weights formed of high-density materials have been attached to the sole. With these weights, the method of installation is critical because the club head endures significant loads at impact with a golf ball, which can dislodge the weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity is too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

Moreover, the addition of localized weights to a golf club head can cause undesirable acoustic effects in the head upon impact. Additionally, such weights can decrease the durability of the golf club head by creating localized stress concentrations in the head.

Accordingly, there is a need for a system for adjustably weighting a golf club head that allows a golfer to fine-tune the club head to accommodate his or her swing without causing significant adverse effects on the acoustic properties or durability of the club head. The present application fulfills this need and others.

SUMMARY

Disclosed below are representative embodiments that are not intended to be limiting in any way. Instead, the present disclosure is directed toward novel and nonobvious features, aspects, and equivalents of the embodiments of the golf club information system described below. The disclosed features and aspects of the embodiments can be used alone or in various novel and nonobvious combinations and sub-combinations with one another.

Briefly, and in general terms, the present application describes localized golf club head weights, and members that stiffen, support, and/or reinforce at least part of a golf club head at or near the weights. The members may thereby modify the acoustic characteristics of the head, improve its durability, and/or provide other advantages.

According to one aspect of the described features, a wood-type golf club head includes a body having one or more walls defining an interior cavity. Weight ports are formed in the body and a weight is configured to be retained at least partially within one of the weight ports. Fins are secured to the weight ports and to at least one of the one or more walls.

According to another aspect, a golf club head includes a body having one or more walls defining an interior cavity. The head includes weight ports that each include a cantilevered portion at least partially within the cavity. Each cantilevered portion includes a base mounted to at least one body wall, and the cantilevered portion extends a cantilevered length from the base. A weight is configured to be retained at least partially within one of the weight ports. A rib is secured to the cantilevered portion of one of the weight ports and to another structural member of the golf club head.

The foregoing and additional features and advantages of the disclosed embodiments will become more apparent from the following detailed description, which proceeds with reference to the following drawings.

DETAILED DESCRIPTION

Disclosed below are representative embodiments that are not intended to be limiting in any way. Instead, the present disclosure is directed toward novel and nonobvious features, aspects and equivalents of the embodiments of the golf club information system described below. The disclosed features and aspects of the embodiments can be used alone or in various novel and nonobvious combinations and sub-combinations with one another.

Figure 1:
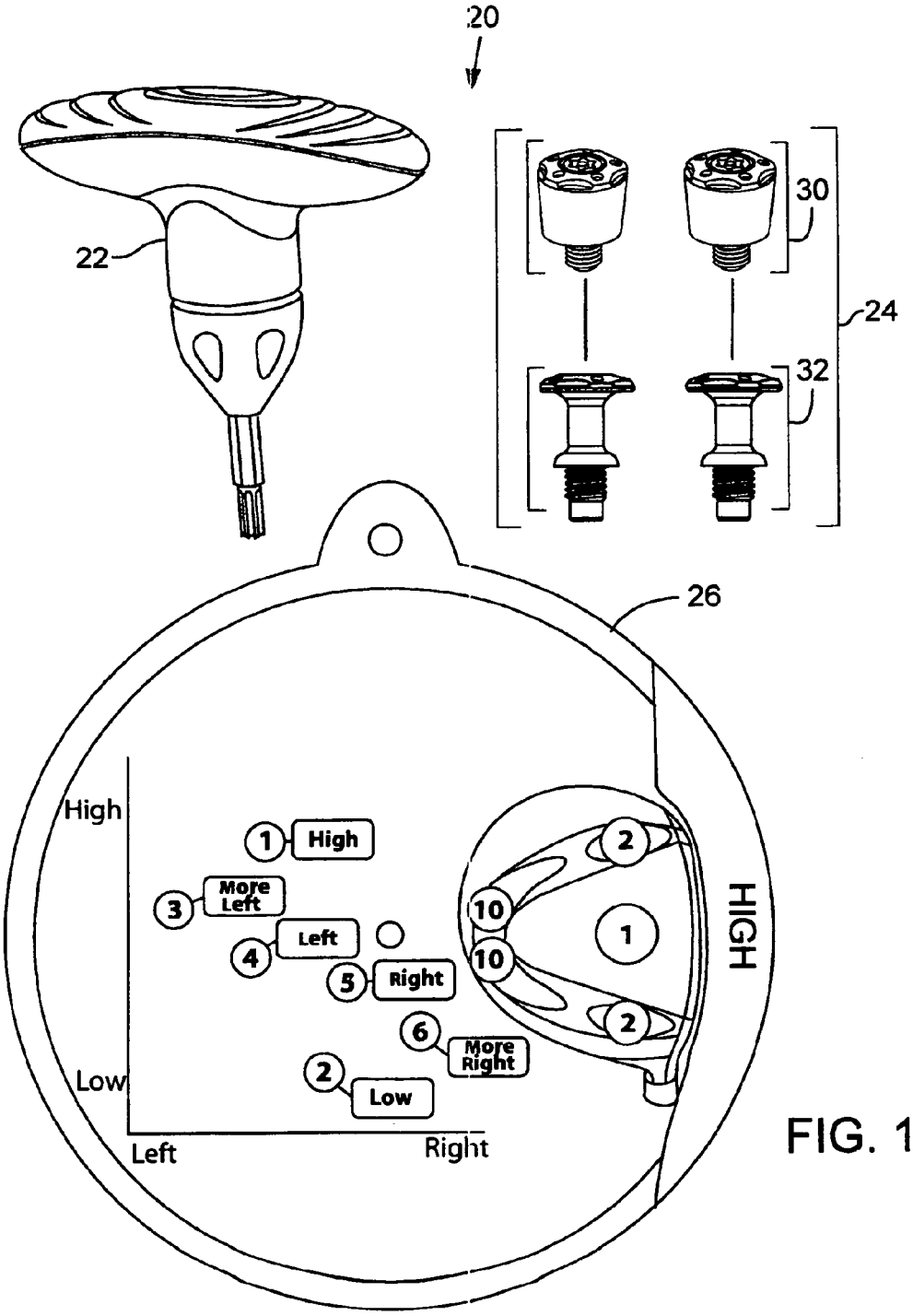
FIG. 1 is a perspective view of an embodiment of a kit for adjustably weighting a golf club head.

Now with reference to the illustrative drawing, and particularly FIG. 1, there is shown a kit 20 having a driving tool, i.e., torque wrench 22, and a set of weights 24 usable with a golf club head having conforming recesses and an instruction wheel 26.

An exemplary club head 28 includes four recesses, e.g., weight ports 96, 98, 102, 104, disposed about the periphery of the club head 28 (FIGS. 2-5). In the exemplary embodiment, four weights 24 are provided: two weight assemblies 30 of about ten grams and two weight screws 32 of about two grams. Although the exemplary embodiment includes four weights 24, two of which are weight assemblies 30 and two of which are weight screws 32, "weights" as used herein, can refer to any number of weights 24, including one or more weight assemblies 30, or one or more weight screws 32, or any combination thereof. In most embodiments, there is one of the weights for each of the weight ports 96, 98, 102, 104.

Varying placement of the weights within weight ports 96, 98, 102 and 104 enables the golfer to vary launch conditions of a golf ball struck by the club head 28, for optimum distance and accuracy. More specifically, the golfer can adjust the position of the club head's center of gravity (CG), for greater control over the characteristics of launch conditions and, therefore, the trajectory and shot shape of a struck golf ball.

With reference to FIGS. 1-5, the weights 24 are sized to be securely received in any of the four weight ports 96, 98, 102, 104 of the club head 28, and are secured in place using the torque wrench 22. The weight assemblies 30 preferably stay in place via a press fit. Weights 24 are configured to withstand forces at impact, while also being easy to remove. The instruction wheel 26 aids the golfer in selecting a proper weight configuration for achieving a desired effect to the trajectory and shape of the golf shot. In some embodiments, the kit 20 provides six different weight configurations for the club head 28, which provides substantial flexibility in positioning the CG of the club head 28. In the exemplary embodiment, the CG of the club head 28 can be adjustably located in an area adjacent to the sole having a length of about five millimeters measured from front-to-rear and width of about five millimeters measured from toe-to-heel. Each configuration delivers different launch conditions, including ball launch angle, spin-rate and the club head's alignment at impact, as discussed in detail below.

Each of the weight assemblies 30 (FIGS. 10-12) includes a mass element 34, a fastener, e.g., screw 36, and a retaining element 38. In the exemplary embodiment, the weight assemblies 30 are preassembled; however, component parts can be provided for assembly by the user.

Figure 9:
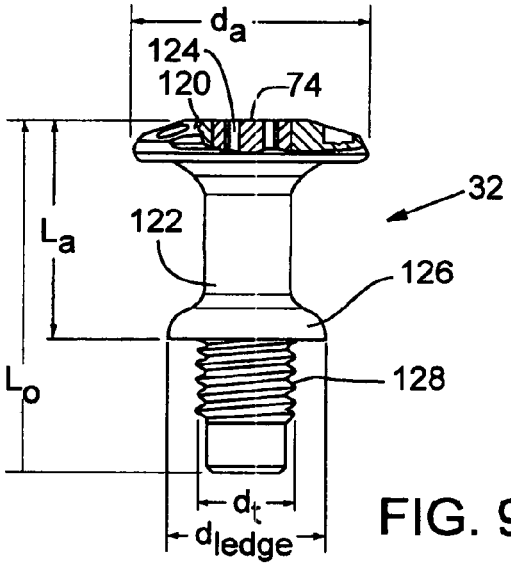
FIG. 9 is a side elevational view of a weight screw of the kit of FIG. 1.

For weights having a total mass between about one gram and about two grams, weights screws 32 without a mass element preferably are used (FIG. 9). The weight screws 32 can be made from any suitable material, including steel or titanium in some implementations and can have a head 120 with an outermost diameter sized to conform to any of the four weight ports 96, 98, 102, 104 of the club head 28.

The kit 20 can be provided with a golf club at purchase, or sold separately. For example, a golf club can be sold with the torque wrench 22, the instruction wheel 26, and the weights 24 (e.g., two 10-gram weight assemblies 30 and two 2-gram weight screws 32) preinstalled. Kits 20 having an even greater variety of weights can also be provided with the club, or sold separately. In another embodiment, a kit 20 having eight weights 24 is contemplated (e.g., a 2-gram weight screw 32, four 6-gram weight assemblies 30, two 14-gram weight assemblies 30, and an 18-gram weight assembly 30. Such a kit 20 may be particularly effective for golfers with a fairly consistent swing, by providing additional precision in weighting the club head 28.

Also, weights in prescribed increments across a broad range can be available. For example, weights 24 in one gram increments ranging from one gram to twenty-five grams can provide very precise weighting, which would be particularly advantageous for advanced and professional golfers. In some embodiments, the weight assembly has a mass between about 1 gram and about 25 grams. In more specific embodiments, the weight assembly has a mass between about 1 gram and about 5 grams, between about 5 grams and about 10 grams, between about 10 grams and about 15 grams or between about 15 grams and about 25 grams. In certain embodiments, weight assemblies 30 ranging between five grams and ten grams preferably use a mass element 34 comprising primarily a titanium alloy. Weight assemblies 30 ranging between ten grams to over twenty-five grams, preferably use a mass element 34 comprising a tungsten-based alloy, or blended tungsten alloys. The mass element 34 can be made from any other suitable material, including, but not limited to, brass, steel, titanium or combinations thereof, to achieve a desired weight mass. Furthermore, the mass element 34 can have a uniform or non-uniform density. The selection of material may also require consideration of other requirements such as durability, size restraints, and removability.

Instruction Wheel

Figure 6:
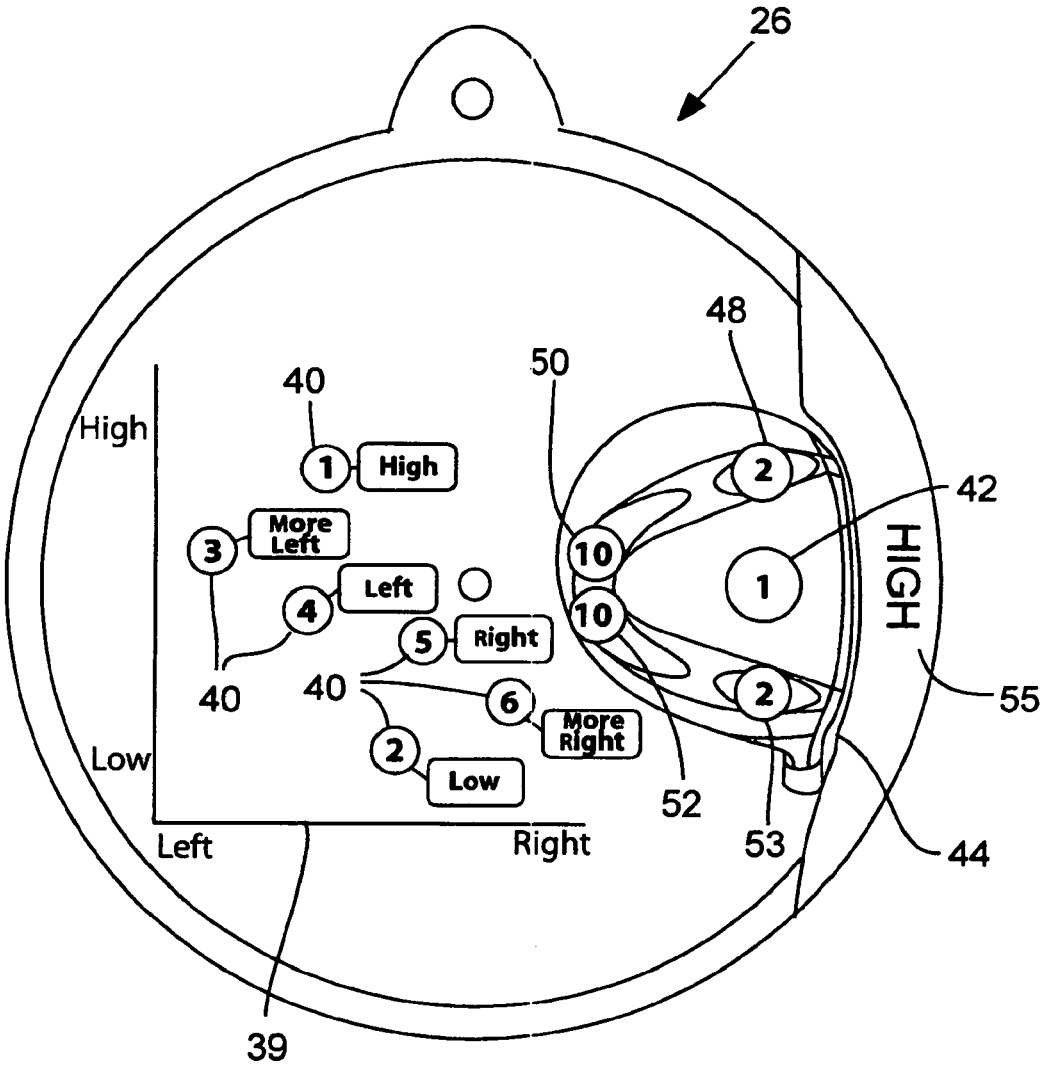
FIG. 6 is a plan view of the instruction wheel of the kit of FIG. 1.

With reference now to FIG. 6, the instruction wheel 26 aids the golfer in selecting a club head weight configuration to achieve a desired effect on the motion path of a golf ball struck by the golf club head 28. The instruction wheel 26 provides a graphic, in the form of a motion path chart 39 on the face of instruction wheel 26 to aid in this selection. The motion path chart's y-axis corresponds to the height control of the ball's trajectory, generally ranging from low to high. The x-axis of the motion path chart corresponds to the directional control of the ball's shot shape, ranging from left to right. In the exemplary embodiment, the motion path chart 39 identifies six different weight configurations 40. Each configuration is plotted as a point on the motion path chart 39. Of course, other embodiments can include a different number of configurations, such as, for kits having a different variety of weights. Also, other approaches for presenting instructions to the golfer can be used, for example, charts, tables, booklets, and so on. The six weight configurations of the exemplary embodiment are listed below in Table 1.

TABLE 1

| Config. | | Weight Distribution | | | |
|---|---|---|---|---|---|
| No. | Description | Fwd Toe | Rear Toe | Fwd Heel | Rear Heel |
| 1 | High | 2 g | 10 g | 2 g | 10 g |
| 2 | Low | 10 g | 2 g | 10 g | 2 g |
| 3 | More Left | 2 g | 2 g | 10 g | 10 g |
| 4 | Left | 2 g | 10 g | 10 g | 2 g |
| 5 | Right | 10 g | 2 g | 2 g | 10 g |
| 6 | More Right | 10 g | 10 g | 2 g | 2 g |

Each weight configuration (i.e., 1 through 6) corresponds to a particular effect on launch conditions and, therefore, a struck golf ball's motion path. In the first configuration, the club head CG is in a center-back location, resulting in a high launch angle and a relatively low spin-rate for optimal distance. In the second configuration, the club head CG is in a center-front location, resulting in a lower launch angle and lower spin-rate for optimal control. In the third configuration, the club head CG is positioned to induce a draw bias. The draw bias is even more pronounced with the fourth configuration. Whereas, in the fifth and sixth configurations, the club head CG is positioned to induce a fade bias, which is more pronounced in the sixth configuration.

Figure 2:
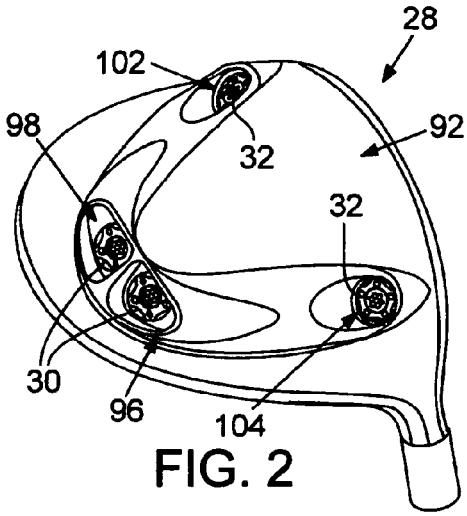
FIG. 2 is a bottom and rear side perspective view of a club head having four weight ports.

In use, the golfer selects, from the various motion path chart descriptions, the desired effect on the ball's motion path. For example, if hitting into high wind, the golfer may choose a golf ball motion path with a low trajectory, (e.g., the second configuration). Or, if the golfer has a tendency to hit the ball to the right of the intended target, the golfer may choose a weight configuration that encourages the ball's shot shape to the left (e.g., the third and fourth configurations). Once the configuration is selected, the golfer rotates the instruction wheel 26 until the desired configuration number is visible in the center window 42. The golfer then reads the weight placement for each of the four locations through windows 48, 50, 52, 53, as shown in the graphical representation 44 of the club head 28. The motion path description name is also conveniently shown along the outer edge 55 of the instruction wheel 26. For example, in FIG. 6, the instruction wheel 26 displays weight positioning for the "high" trajectory motion path configuration, i.e., the first configuration. In this configuration, two 10-gram weights are placed in the rear ports 96, 98 and two 2-gram weights are placed in the forward ports 102, 104 (FIG. 2). If another configuration is selected, the instruction wheel 26 depicts the corresponding weight distribution, as provided in Table 1, above.

Torque Wrench

Figure 7:
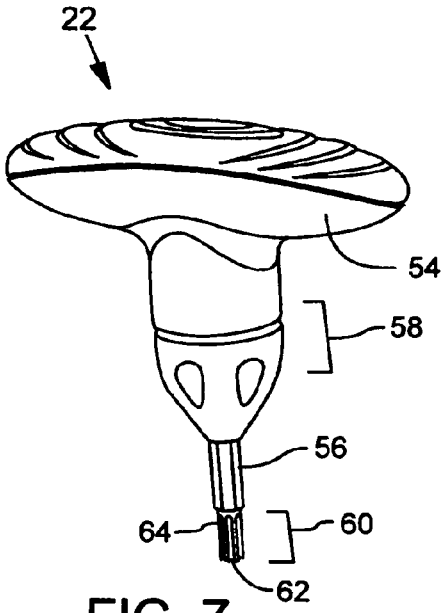
FIG. 7 is a perspective view of the tool of the kit of FIG. 1, depicting a grip and a tip.
Figure 8:
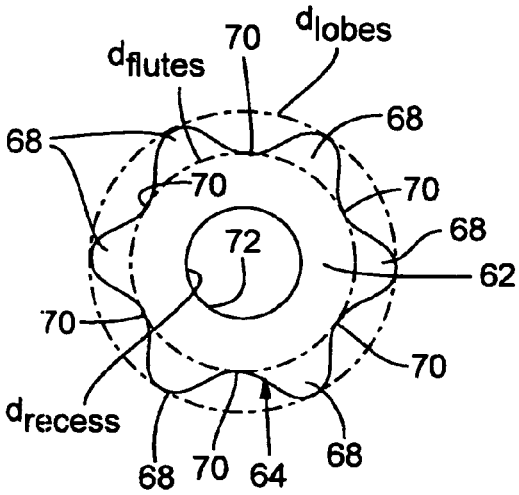
FIG. 8 is a close-up plan view of the tip of the tool of FIG. 7.

With reference now to FIGS. 7-8, the torque wrench 22 includes a grip 54, a shank 56, and a torque-limiting mechanism (not shown). The grip 54 and shank 56 generally form a T-shape; however, other configurations of wrenches can be used. The torque-limiting mechanism is disposed between the grip 54 and the shank 56, in an intermediate region 58, and is configured to prevent over-tightening of the weights 24 into the weight ports 96, 98, 102, and 104. In use, once the torque limit is met, the torque-limiting mechanism of the exemplary embodiment will cause the grip 54 to rotationally disengage from the shank 56. In this manner, the torque wrench 22 inhibits excessive torque on the weight 24 being tightened. Preferably, the wrench 22 is limited to between about twenty inch-lbs. and forty inch-lbs. of torque. More preferably, the limit is between twenty-seven inch-lbs and thirty-three inch-lbs of torque. In the exemplary embodiment, the wrench 22 is limited to about thirty inch-lbs. of torque. Of course, wrenches having various other types of torque-limiting mechanisms, or even without such mechanisms, can be used. However, if a torque-limiting mechanism is not used, care should be taken not to over-tighten the weights 24.

Figure 10:
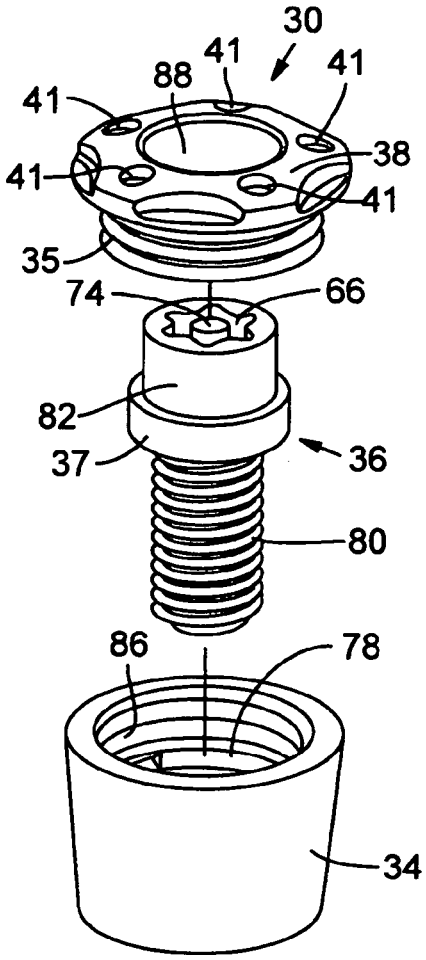
FIG. 10 is an exploded perspective view of a weight assembly of the kit of FIG. 1.
Figure 11:
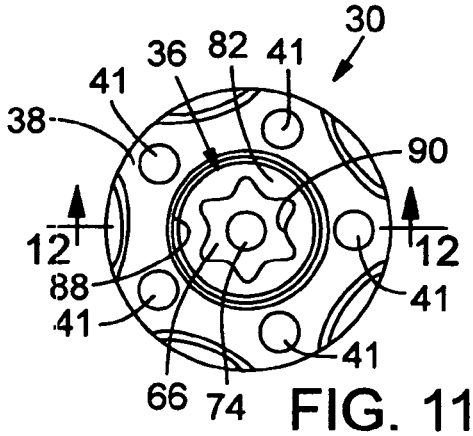
FIG. 11 is a top plan view of the weight assembly of FIG. 10.

The shank 56 terminates in an engagement end, i.e., tip 60, configured to operatively mate with the weight screws 32 and the weight assembly screws 36 (FIGS. 9-11). The tip 60 includes a bottom wall 62 and a circumferential side wall 64. As shown in FIGS. 9-11, the head of each of the weight screws 32 and weight assembly screws 36 defines a socket 124 and 66, respectively, having a complementary shape to mate with the tip 60. The side wall 64 of the tip 60 defines a plurality of lobes 68 and flutes 70 spaced about the circumference of the tip. The multi-lobular mating of the wrench 22 and the sockets 66 and 124 ensures smooth application of torque and minimizes damage to either device (e.g., stripping of tip 60 or sockets 66, 124). The bottom wall 62 of the tip 66 defines an axial recess 72 configured to receive a post 74 disposed in sockets 66 and 124. The recess 72 is cylindrical and is centered about a longitudinal axis of the shank 56.

With reference now to FIG. 8, the lobes 68 and flutes 70 are spaced equidistant about the tip 60, in an alternating pattern of six lobes and six flutes. Thus, adjacent lobes 68 are spaced about 60 degrees from each other about the circumference of the tip 60. In the exemplary embodiment, the tip 60 has an outer diameter ($d_{lobes}$), defined by the crests of the lobes 68, of about 4.50 mm, and trough diameter ($d_{flutes}$) defined by the troughs of the flutes 70, of about 3.30 mm. The axial recess has a diameter ($d_{recess}$) of about 1.10 mm. Each socket 66, 124 is formed in an alternating pattern of six lobes 90 that complement the six flutes 70 of the wrench tip 60.

Weights

Generally, as shown in FIGS. 1 and 9-12, weights 24, including weight assemblies 30 and weight screws 32, are non-destructively movable about or within golf club head 28. In specific embodiments, the weights 24 can be attached to the club head 28, removed, and reattached to the club head without degrading or destroying the weights or the golf club head. In other embodiments, the weights are accessible from an exterior of the golf club head.

With reference now to FIG. 9, each weight screw 32 has a head 120 and a body 122 with a threaded portion 128. The weight screws 32 are preferably formed of titanium or stainless steel, providing a weight with a low mass that can withstand forces endured upon impacting a golf ball with the club head 28. In the exemplary embodiment, the weight screw 32 has an overall length ($L_o$) of about 18.3 mm and a mass of about two grams. In other embodiments, the length and composition of the weight screw 32 can be varied to satisfy particular durability and mass requirements. The weight screw head 120 is sized to enclose one of the corresponding weight ports 96, 98, 102, 104 (FIG. 2) of the club head 28, such that the periphery of the weight screw head 120 generally abuts the side wall of the port. This helps prevent debris from entering the corresponding port. Preferably, the weight screw head 120 has a diameter ranging between about 11 mm and about 13 mm, corresponding to weight port diameters of various exemplary embodiments. In this embodiment, the weight screw head has a diameter of about 12.3 mm. The weight screw head defines a socket 124 having a multi-lobular configuration sized to operatively mate with the wrench tip 60.

The body 122 of the weight screw 32 includes an annular ledge 126 located in an intermediate region thereof. The ledge 126 has a diameter ($d_{ledge}$) greater than that of the threaded openings 110 defined in the ports 96, 98, 102, 104 of the club head 28 (FIG. 2), thereby serving as a stop when the weight screw 32 is tightened. In the embodiment, the annular ledge 126 is a distance ($L_a$) of about 11.5 mm from the weight screw head 120 and has a diameter ($d_a$) of about 6 mm. The weight screw body 122 further includes a threaded portion 128 located below the annular ledge 126. In this embodiment, M5 X 0.6 threads are used. The threaded portion 128 of the weight screw body 122 has a diameter ($d_t$) of about 5 mm and is configured to mate with the threaded openings 110 defined in the ports 96, 98, 102, 104 of the club head 28.

Figure 12:
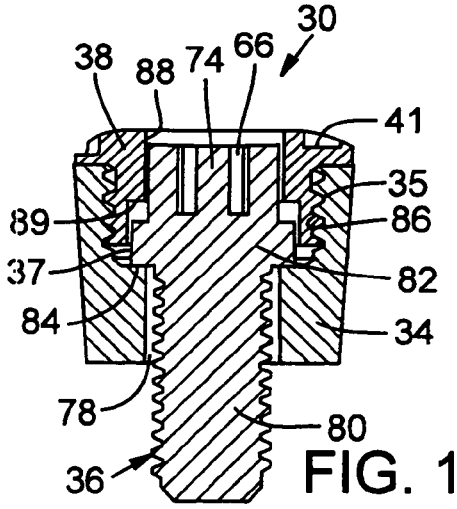
FIG. 12 is a cross sectional view of the weight assembly of FIG. 10, taken along line 12-12 of FIG. 11.

With reference now to FIGS. 10-12, each mass element 34 of the weight assemblies 30 defines a bore 78 sized to freely receive the weight assembly screw 36. As shown in FIG. 12, the bore 78 includes a lower non-threaded portion and an upper threaded portion. The lower portion is sufficiently sized to freely receive a weight assembly screw body 80, while not allowing the weight assembly screw head 82 to pass. The upper portion of the bore 78 is sufficiently sized to allow the weight assembly screw head 82 to rest therein. More particularly, the weight assembly screw head 82 rests upon a shoulder 84 formed in the bore 78 of the mass element 34. Also, the upper portion of the bore 78 has internal threads 86 for securing the retaining element 38. In constructing the weight assembly 30, the weight assembly screw 36 is inserted into the bore 78 of the mass element 34 such that the lower end of the weight assembly screw body 80 extends out the lower portion of the bore 78 and the weight assembly screw head 82 rests within the upper portion of the bore 78. The retaining element 38 is then threaded into the upper portion of the bore 78, thereby capturing the weight assembly screw 36 in place. A thread locking compound can be used to secure the retaining element 38 to the mass element 34.

The retaining element 38 defines an axial opening 88, exposing the socket 66 of the weight assembly screw head 82 and facilitating engagement of the wrench tip 60 in the socket 66 of the weight assembly screw 36. As mentioned above, the side wall of the socket 66 defines six lobes 90 that conform to the flutes 70 (FIG. 8) of the wrench tip 60. The cylindrical post 74 of the socket 66 is centered about a longitudinal axis of the screw 36. The post 74 is received in the axial recess 72 (FIG. 8) of the wrench 22. The post 74 facilitates proper mating of the wrench 22 and the weight assembly screw 36, as well as inhibiting use of non-compliant tools, such as Phillips screwdrivers, Allen wrenches, and so on.

Club Head

As illustrated in FIGS. 2-5 and 13-16, a golf club head 28 of the present application includes a body 92. The body 92 can include a crown 141, sole 143, skirt 145 and face plate 148 defining an interior cavity 150. The body further includes a heel portion 151, toe portion 153 and rear portion 155.

The crown 141 includes an upper portion of the golf club head 28 above a peripheral outline of the head and top of the face plate 148.

The sole 143 includes a lower portion of the golf club head 28 extending upwards from a lowest point of the club head when the club head is ideally positioned, i.e., at a proper address position. For a typical driver, the sole 143 extends upwards approximately 15 mm above the lowest point when the club head is ideally positioned. For a typical fairway wood, the sole 143 extends upwards approximately 10-12 mm above the lowest point when the club head is ideally positioned. A golf club head, such as the club head 28 can be ideally positioned when angle 163 (FIG. 3) measured between a plane tangent to the an ideal impact location on the face plate and a perfectly vertical plane relative to the ground is approximately equal to the golf club head loft and when the ideal golf club head lie angle is approximately equal to an angle between a longitudinal axis of the hosel or shaft and the ground 161. Impact axis 159 passes through the ideal impact location and is oriented generally parallel to the ground and perpendicular to a horizontal axis disposed in a plane tangent to the ideal impact location. The ideal impact location is disposed at the geometric center of the face plate. The sole 143 can also include a localized zone 189 proximate the face plate 148 having a thickness between about 1 mm and 3 mm, and extending rearward away from the face plate a distance greater than about 5 mm.

The skirt 145 includes a side portion of the golf club between the crown and the sole that extends across a periphery of the golf club head, excluding the face plate, from the toe portion 153, around the rear portion 155, to the heel portion 151.

The crown, sole and skirt can be integrally formed using techniques such as molding, cold forming, casting, and/or forging and the face plate can be attached to the crown, sole and skirt by means known in the art. Furthermore, the body can be made from a metal (titanium, steel alloy, aluminum alloy, magnesium, etc.), composite material, ceramic material, or any combination thereof.

With reference again to FIGS. 2-5 and 13-16, the club head 28 can include a thin-walled body 92 and a face plate 148.

The weights 24 of the present application can be accessible from the exterior of the club head 28 and securely received by the weight ports 96, 98, 102, and 104. Weight ports can be generally described as a structure coupled to (such as by being formed integrally with, welded or adhered to, secured to in a press fit, etc.) the golf club head crown, golf club head skirt, golf club head sole or any combination thereof that defines a recess, cavity or hole on, about or within the golf club head. The four ports 96, 98, 102, and 104 of the club head 28 are positioned low about the periphery of the body 92, providing a low center of gravity and a high moment of inertia. More particularly, first and second ports 96, 98 are located in a rear portion 155 of the club head 28, and the third and fourth ports 102 and 104 are located in a toe portion 153 and a heel portion 151 of the club head 28, respectively. Fewer, such as two or three weights, or more than four weights may be provided as desired.

Figure 5:
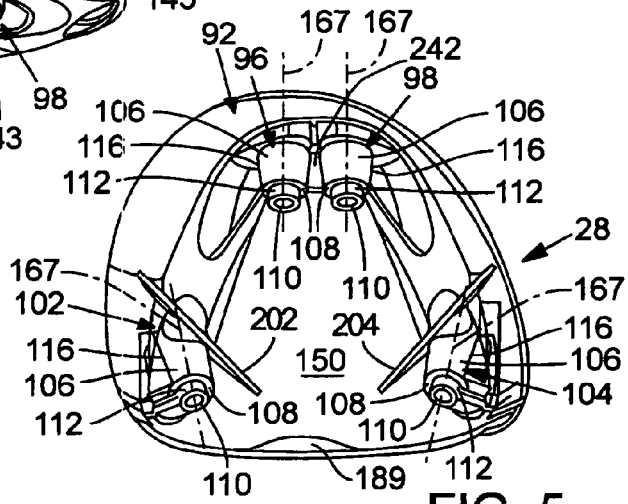
FIG. 5 is a cross sectional view of the club head of FIG. 2, taken along line 5-5 of FIG. 4.

The ports 96, 98, 102, and 104 are each defined by a port wall 106 defining a weight cavity 116 (see FIG. 15) and a port bottom 108. In embodiments of a weight having a mass element with tapered outer surfaces, the port wall 106 is correspondingly tapered to receive and secure the mass element in place via a press fit. The port bottom 108 defines a threaded opening 110 (see FIG. 15) for attachment of the weights 24. The threaded opening 110 is configured to receive and secure the threaded portion of the weight assembly screw body 80 and weight screw threaded portion 128. In this embodiment, the threaded bodies 80 and 128 of the weight assembly 30 and weight screw 32, respectively, have M5 X 0.6 threads. In other embodiments, the thread pitch is about 0.8. The threaded opening 110 may be further defined by a boss 112 extending either inward or outward relative to the weight cavity 116. Preferably, the boss 112 has a length at least half the length of the body 80 of the weight assembly screw 36 and, more preferably, the boss 112 has a length 1.5 times a diameter of the body of the screw. As depicted in FIG. 5, the boss 112 extends outward, relative to the weight cavity 116 and includes internal threads (not shown). Alternatively, the threaded opening 110 may be formed without a boss 112. The ports have a weight port radial axis 167 defined as a longitudinal axis passing through a volumetric centroid, i.e., the center of mass or center of gravity, of the weight port.

In this embodiment, the club head 28 has a volume of about 460 cc and a total mass of about 200 grams, of which the face plate 148 accounts for about 24 grams. As depicted in FIG. 2, the club head 28 is weighted in accordance with the first configuration (i.e., "high") of Table 1, above. With this arrangement, a moment of inertia about a vertical axis at a center of gravity of the club head 28, Izz, is about 405 kg-$mm^2$. Various other designs of club heads and weights may be used, such as those disclosed in Applicant's co-pending application Ser. No. 10/290,817 filed Nov. 8, 2002, which is herein incorporated by reference. Furthermore, other club head designs known in the art can be adapted to take advantage of features of the present invention.

To attach a weight assembly, such as weight assembly 30, in a port of a golf club head, such as the club head 28, the threaded portion of the weight assembly screw body 80 is aligned with the threaded opening 110 of the port. With the tip 60 of the wrench 22 inserted through the aperture 88 of the retaining element 38 and engaged in the socket 66 of the weight assembly screw 36, the user rotates the wrench to screw the weight assembly 30 in place. Torque from the engagement of the weight assembly screw 36 provides a press fit of the mass element 34 to the port. As sides of the mass element 34 slide tightly against the port wall 106, the torque limiting mechanism of the wrench 22 prevents over-tightening of the weight assembly 30. Similarly, in embodiments using a sleeved mass element, the outer surface of the sleeve achieves a tight fit against the port wall 106.

Weight assemblies 30 are also configured for easy removal, if desired. To remove, the user mates the wrench 22 with the weight assembly 30 and unscrews it from a club head. As the user turns the wrench 22, the head 82 of the weight assembly screw 36 applies an outward force on the shoulder 89 of the retaining element 38, thereby extracting the mass element 34 from the weight cavity 116. A low friction material can be provided on surfaces of the retaining element 38 and the mass element 34 to facilitate free rotation of the head 82 of the weight assembly screw 36 with respect to the retaining element 38 and the mass element 34.

Similarly, a weight screw, such as weight screws 32, can be attached to the body through a port by aligning the threaded portion of weight 32 with the threaded opening 110 of the port. The tip of the wrench can be used to engage the socket of the weight by rotating the wrench to screw the weight in place.

Although conventional threaded type connections between screws 36, 32 and the threaded opening 110 of the port, and the between the retaining element 38 and the mass element 34, have been forthwith described, other sorts of coupling methods allowing assembly and disassembly of concentric elements could also be used.

A. RIBS EXAMPLE 1

Figure 13:
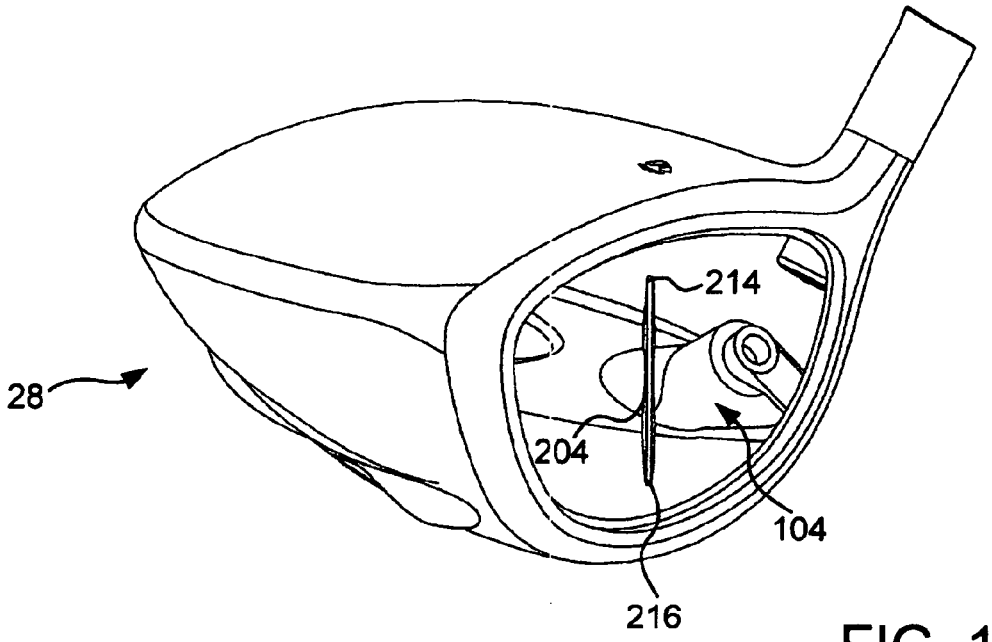
FIG. 13 is a top and front perspective view of the club head of FIG. 2 with the face plate omitted to reveal internal features of the head.
Figure 14:
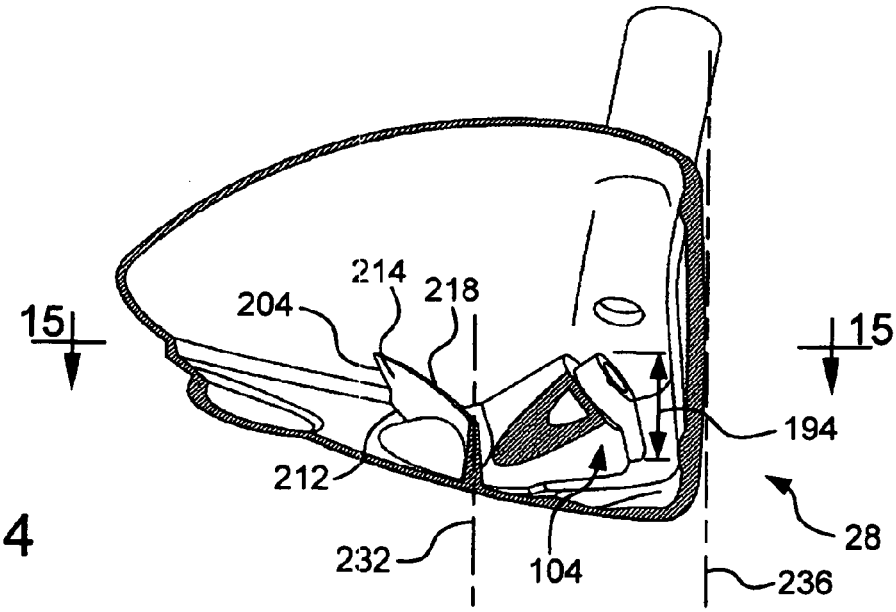
FIG. 14 is a side cross sectional view the golf club head of FIG. 2 taken along line 14-14 of FIG. 15.
Figure 15:
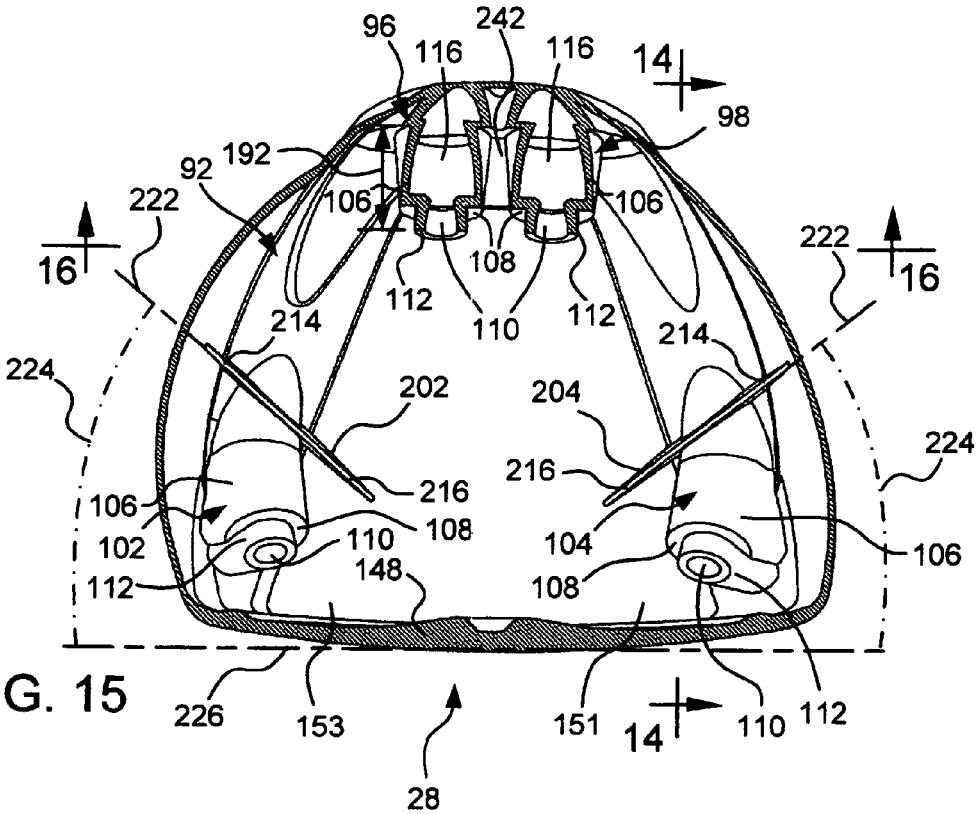
FIG. 15 is a top cross sectional view the club head of FIG. 2 taken along line 15-15 of FIG. 14.
Figure 16:
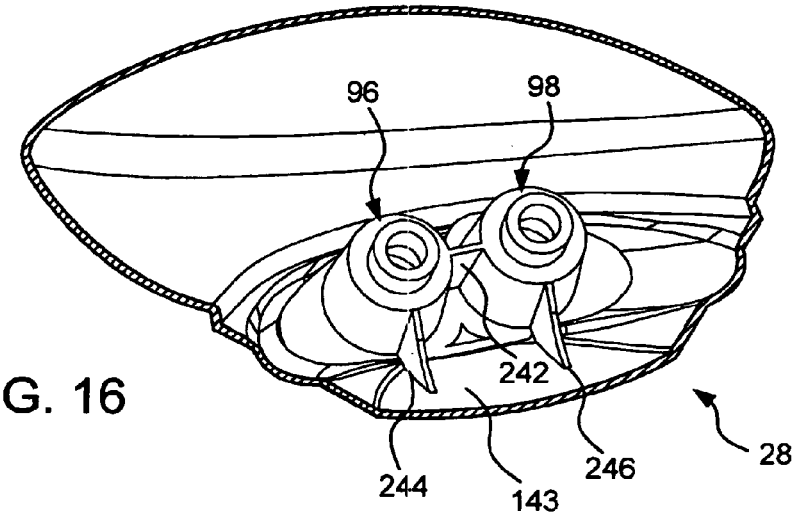
FIG. 16 is a perspective cross sectional view of a section taken along line 16-16 of FIG. 15.

As depicted in FIG. 5, and depicted in more detail in FIGS. 13-15, a pair of front port ribs or fins 202, 204 are located generally in the front area of the head 28. Specifically, a toe rib 202 is located proximate the toe region 153 and is secured to the port 102 located in the toe region 153, and a heel rib 204 is located proximate the heel region 151 and is secured to the port 102 located in the heel region 151. Each front rib 202, 204 includes a lower edge 212 that is formed in both the wall of the sole region and the base of the respective port 102, 104, thereby securing the rib to the respective port 102, 104 and to the body of the head 28. Specifically, the lower edge 212 extends from an outer region 214 of the rib 202, 204 where the lower edge abuts an outer area of the sole wall. Each outer rib region 214 is located generally midway between the rear portion 155 of the head 28 and the respective heel or toe portions 151, 153. As the rib 202, 204 slopes forward and inward, the lower edge 212 extends across the respective port 102, 104 and to an inner region 216 of the rib where the lower edge is formed in the central portion of the sole wall. Each front rib 202, 204 also includes an exposed upper edge 218, which forms a convex arc opposite the lower edge that extends from the outer rear region 214 to the inner front region 216. As is illustrated for the rib 204 in FIG. 14, the lower edge 212 of each rib 202, 204 is secured to the sole wall and to the respective port 102, 104.

Figure 3:
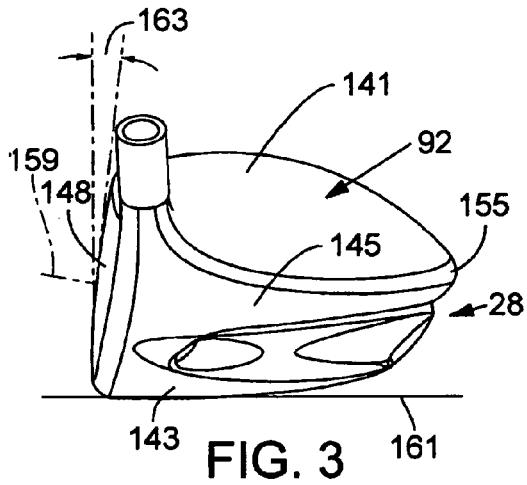
FIG. 3 is a side elevational view of the club head of FIG. 2, depicted from the heel side of the club head.
Figure 4:
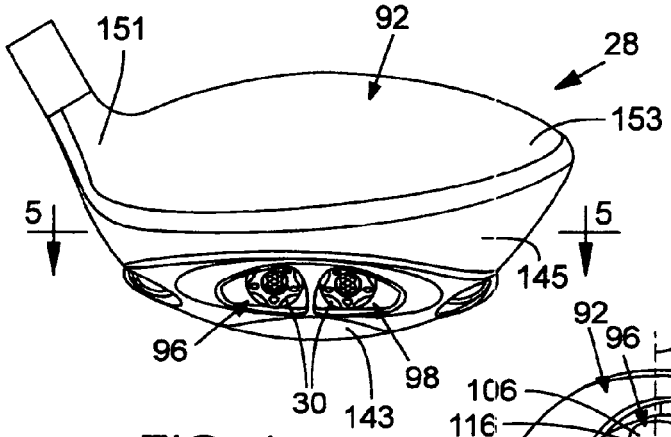
FIG. 4 is a rear elevational view of the club head of FIG. 2.

A horizontal axis 222 extending along each rib 202, 204 forms an angle 224 with respect to a horizontal axis 226 that extends generally along the face plate 148 of the head 28. In one implementation, the angle 224 is about 45 degrees. However, the angle could have other values, including zero, and the angles could be different for each of the ribs 202, 204. A height axis 232 of each rib that is perpendicular to the horizontal axis of each rib is generally parallel to a height axis 236 of the face plate that is perpendicular to the horizontal axis of the face plate. However, the height axes 232 of the ribs could be angled with respect to the face plate, such as at an angle that is equal to the loft 163 (FIG. 3).

As is illustrated in FIG. 14, each front rib 202, 204 is tapered so that it is thicker at its lower edge 212 than at its upper edge 218. However, the ribs could be a constant thickness, or their thickness could vary in some other manner.

It is preferable for each of the front ribs 202, 204 to extend at least about 2 mm above the tallest sole feature that it intersects, which in this implementation is the base of the respective weight ports 102, 104. It is even more preferable for the ribs to extend at least 5 mm above the tallest sole feature that it intersects. However, the ribs can be arranged so that they do not extend above the sole features that they intersect.

The head 28 has rear ribs or fins secured to the rear weight ports 96, 98, including a generally horizontal rib 242 that is secured to both rear weight ports 96, 98, and to the rear of the sole 143. The head 28 also includes bottom ribs 244, 246 that extend down from each of the respective rear weight ports 96, 98 and are secured to the sole 143 below the weight ports 96, 98. Specifically, the bottom ribs 244, 246 are generally triangular in shape, and each includes one edge that extends forward from the cantilevered base of each rear port 96, 98 at the rear of the sole 143 along the cantilevered length of the bottom of the respective rear port 96, 98. A second edge of each bottom rib 244, 246 extends forward from the base of the respective port 96, 98 along the sole 143. A third edge is exposed and faces forward. The ribs 244, 246 are formed integrally with, and thereby secured to, the ports 312, 314 and the rear of the sole 304.

It is desirable for each of the ribs 242, 244, 246 to extend axially along at least 20 percent of the cantilevered length of the rear weight ports 96, 98, and even more desirable for the ribs to extend along at least 80 percent of the cantilevered length.

In one embodiment, the ribs were about one millimeter thick. However, a rib thickness of about 0.8 millimeter may provide similar results. Of course, the particular dimensions of the ribs may vary, and optimal dimensions may be different for different head designs.

It is believed that the ribs stiffen and reinforce various features of the head without adding significant additional weight to the golf club head. The advantages of such stiffening features are especially apparent in the weight ports and surrounding features. Without the ribs, the weight ports can cause first-mode vibration frequencies in the range of about 1000 Hz to about 3000 Hz. Such vibration modes may result in undesirable feel through auditory and/or tactical feedback to a golfer. Preferably, the first mode vibration frequency for a wood-type golf club head is greater than about 3000 Hz. The addition of ribs secured to the weight ports can significantly increase the first mode vibration frequency, thus allowing the first mode to approach a more desirable level, thereby improving the feel of the golf club to a user. For example, two golf club head designs were analyzed using finite element analysis, such as the finite element analysis feature available with many commercially available computer aided design and modeling software programs, such as Hypermesh by Altair Engineering and Abaqus by STET Inc. The first golf club head design was titanium and was shaped similar to the head shown in FIGS. 2-5 and 13-16, but it did not have ribs secured to the weight ports. The analysis predicted that a head made according to this no-rib design would have a first vibration mode in an undesirable frequency range. However, in the second design, which was the same as the first but with the addition of the ribs discussed above, the finite element analysis predicted a significant increase in the first vibration mode frequency, such that the predicted first vibration mode was within a more desirable frequency range. The ribs, while increasing the weight of the head by only about four percent, increased the predicted frequency of the first vibration mode by more than ten percent. An actual golf club head made substantially according to the rib design shown in FIGS. 2-5 and 13-15 was tested and found to have an actual audible first mode frequency approximately 17 percent higher than predicted, and more than 30 percent higher than the no-rib design described above.

It is believed that the increase in the frequency of the audible first mode is due at least in part to the ribs stiffening the weight ports, which act as cantilevered beams within the head. The vibration of a cantilevered beam is generally a function of its stiffness-to-mass ratio (the higher the stiffness-to-mass ratio, the higher the frequency of vibration of the beam). The ribs increase the stiffness of the weight ports without significantly increasing the weight of the head. More specifically, it is believed that the ribs provide a more rigid boundary condition at the base of the cantilevered portion of the weight ports, and/or increase the section inertia near the base of the cantilevered portion of the weight ports. The ribs may also increase the stiffness by tying the weight ports and/or the walls on which the weight ports are mounted to one or more node lines (i.e., regions of the golf club head having little vibration movement). Thus, it is often desirable for the ribs to extend from the corresponding weight port to a nearby node line. Node lines are often located near sharp changes in curvature, and can be located for particular designs using commercially-available finite element analysis software.

Other advantages of the ribs may include decreasing the peak bending stress at the base of the weight ports. This may improve the durability of the club head by decreasing failure rates near the bases of weight ports in some designs. Additionally, it is possible that in some designs the weight ports may distort during golf-ball impact, allowing the weight to move within the weight port so that the bolt preload (the force due to tightening the threaded connection between the weight and weight port) is decreased. It is believed that the ribs may decrease this effect by decreasing distortion of the weight ports during impact.

B. RIBS EXAMPLE 2

Figure 17:
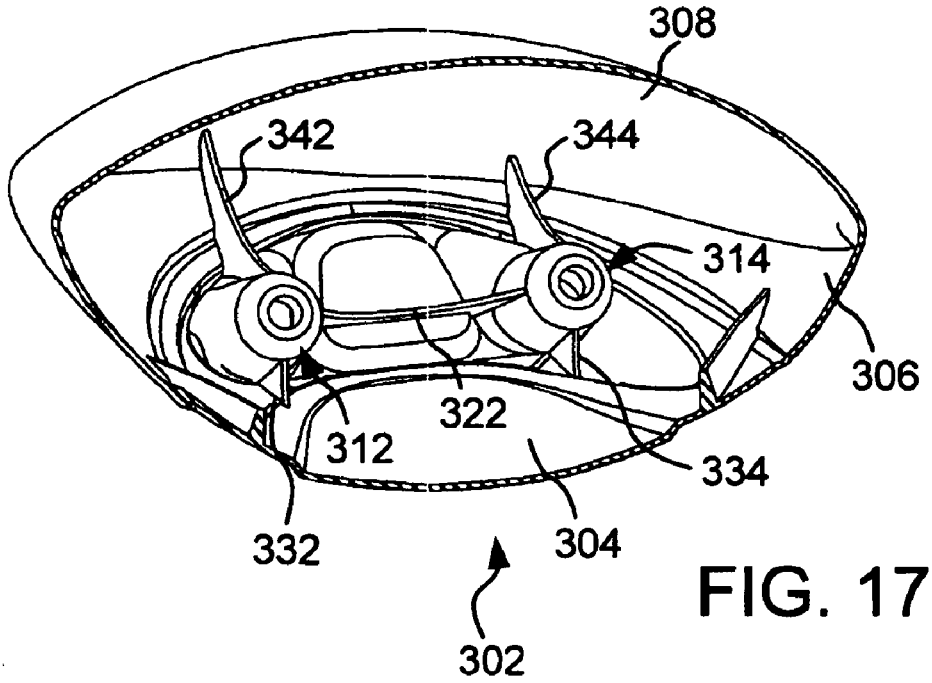
FIG. 17 is a perspective cross sectional view similar to FIG. 16 depicting a rear portion of another golf club head.
Figure 18:
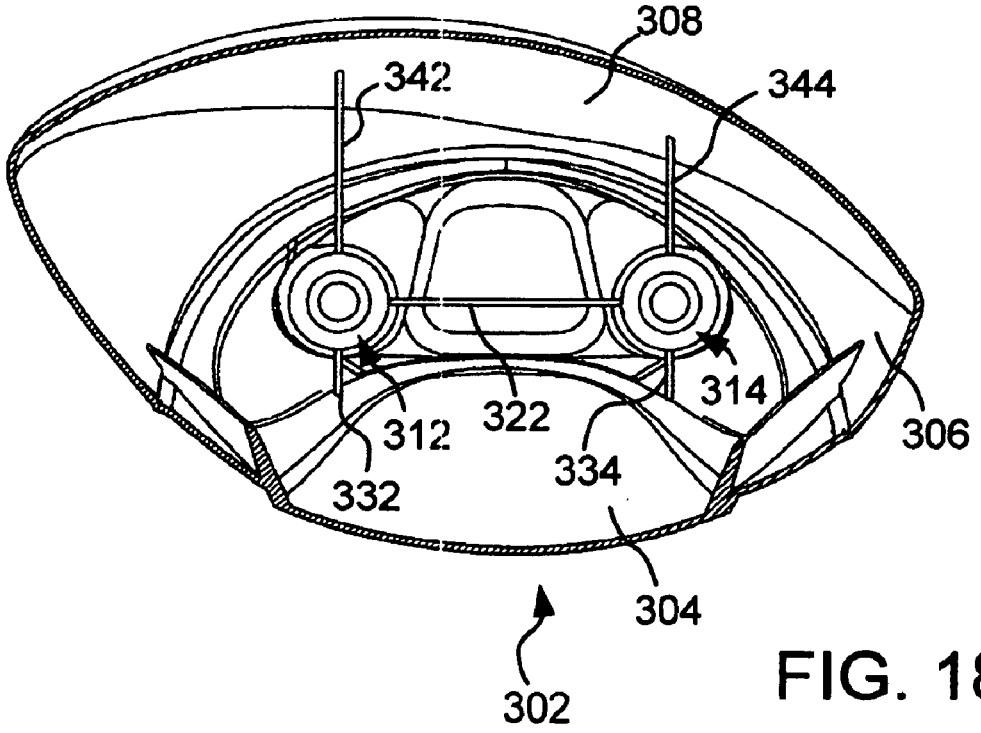
FIG. 18 is a front cross sectional view of the rear portion of the club head of FIG. 17.

An alternative configuration for ribs is shown in FIGS. 17-18, which illustrate a rear portion 302 of a golf club head. The rear portion 302 includes a rear portion of the sole 304, a rear portion of the skirt 306, and a rear portion of the crown 308. A pair of rear weight ports 312, 314 similar to the weight ports 96, 98 illustrated above are formed in the rear portion of the sole 304. A generally horizontal rib 322 extends forward from the rear of the sole 304 along about eighty percent of the cantilevered length of inward-facing sides of both rear ports 312, 314. A forward edge of the rib 322 is concavely curved so that the rib tapers to a central region mid-way between the two ports 312, 314 that does not extend forward as far as the ends proximate the ports. The rib 322 is formed integrally with, and thereby secured to, the ports 312, 314 and the rear of the sole 304.

A pair of generally triangular-shaped bottom ribs 332, 334 each include one edge that extends forward from the cantilevered base of each rear port 312, 314 at the rear of the sole 304 along about 80 percent of the cantilevered length of the bottom of the respective rear ports 312, 314. A second edge of each bottom rib 332, 334 extends forward from the base of the respective port 312, 314 along the bottom of the sole 304. A third edge is exposed and faces forward. The ribs 332, 334 are formed integrally with, and thereby secured to, the ports 312, 314 and the rear of the sole 304.

A pair of three-edged top ribs 342, 344 each include one edge that extends forward from the cantilevered base of each port 312, 314 along about 80 percent of the cantilevered length of the top of the respective rear ports 312, 314. A second edge of each top rib 342, 344 extends generally up from the base of the respective port 312, 314 along the rear of the sole 304, the skirt 306, and the crown 308. The ribs 342, 344 are formed integrally with, and thereby secured to, the ports 312, 314 and the rear portions of the sole 304, the skirt 306, and the crown 308.

C. RIBS EXAMPLE 3

Figure 19:
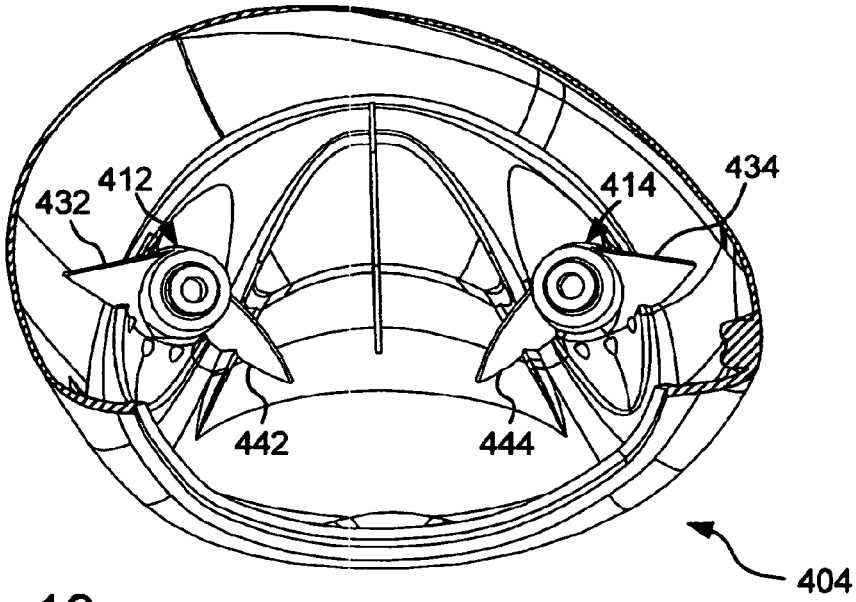
FIG. 19 is a front perspective cross sectional view of a lower portion of yet another club head.
Figure 20:
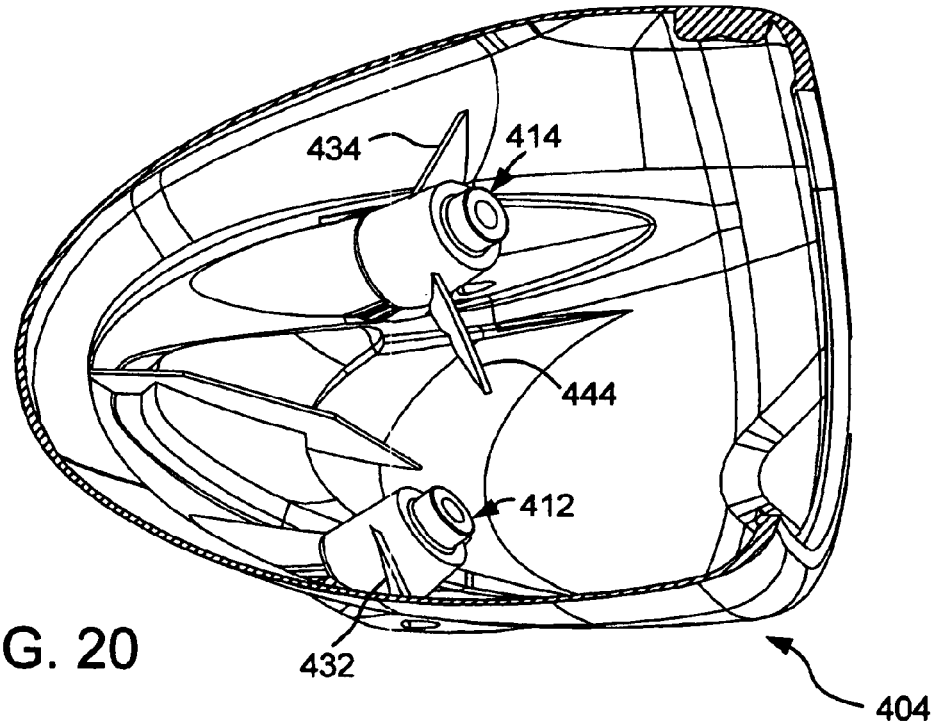
FIG. 20 is a top and side perspective cross sectional view of the section of the golf club head of FIG. 19.

Yet another alternative rib configuration is shown in FIGS. 19-20, which illustrate a lower portion of a golf club head including a sole 404 of a golf club head. A pair of weight ports 412, 414 similar to the weight ports 96, 98 illustrated above is formed in the sole 404.

A pair of generally triangular-shaped outer ribs 432, 434 each include one edge that extends upward from the cantilevered base of each rear port 412, 414 in a spiral along about half of the cantilevered length of the outer-facing sides of the respective rear ports 412, 414. A second edge of each outer rib 432, 434 extends out from the base and away from the center of the head, along the bottom of the sole 404. A third edge is exposed and faces upward as it angles from a point along the side of the respective port 412, 414 outward to the sole 404. Thus, the outer ribs 432, 434 extend outward from the respective ports 412, 414. The ribs 432, 434 are formed integrally with, and thereby secured to, the sole 404 and the ports 412, 414.

A pair of three-edged inner ribs 442, 444 each includes one edge that extends from the cantilevered base of each port 412, 414 in a spiral along about half of the cantilevered length of the inner-facing side of the respective rear ports 412, 414. A second edge of each inner rib 442, 444 extends inward and forward from the base of the respective port 412, 414 along the sole 404. A third edge is exposed and faces upward as it angles from a point along the side of the respective port 412, 414 down and inward to the sole 404. The ribs 442, 444 are formed integrally with, and thereby secured to, the ports 412, 414 and to the sole 404.

While the ribs in the various configurations described above can be cast or otherwise formed in the same process as the body of the head so that they are formed integrally with the body walls and the weight ports, the ribs can alternatively be formed separately and later secured to the walls and weight ports, such as by welding or applying an adhesive. Moreover, the ribs could be made of different materials, such as composite materials.

Additionally, while particular configurations of ribs have been described above, many other configurations are possible. For example, ribs could have many different shapes, such as rectangular shapes, shapes with internal cut-out portions, etc. As another example, different numbers of ribs per port, or different numbers of ports are also possible, such as a golf club head with three ports each having a single rib.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

We claim:

1. A wood-type golf club head comprising:

a body comprising one or more walls defining an interior cavity and an exterior surface;

at least one weight port formed in the body, the at least one weight port opening to the exterior surface and configured to receive a weight; and at least one rib in the interior cavity of the body, the at least one rib secured to the at least one weight port and to at least one of the one or more walls, wherein the at least one weight port comprises a weight port having a cantilevered portion.

2. The golf club head of claim 1, wherein the body comprises a face plate positioned at a forward portion of the golf club head, a sole positioned at a bottom portion of the golf club head, a crown positioned at a top portion of the golf club head, and a skirt positioned around a periphery of the golf club head between the sole and the crown.

3. The golf club head of claim 2, wherein the at least one weight port comprises at least one weight port positioned in a rear portion of the golf club head distal from the face plate.

4. The golf club head of claim 2, wherein a horizontal axis of the at least one rib forms a non-zero angle relative to a horizontal axis along the face plate.

5. The golf club head of claim 1, wherein a first mode of vibration of the head is greater than about 3400 Hz.

6. A wood-type golf club head comprising:

a body comprising one or more walls defining an interior cavity and an exterior surface;

at least one weight port formed in the body, the at least one weight port comprising a cantilevered portion and opening to the exterior surface and configured to receive a weight; and at least one rib in the interior cavity of the body, the at least one rib secured to the at least one weight port and to at least one of the one or more walls, wherein a horizontal axis of the at least one rib forms a non-zero angle relative to a horizontal axis along the face plate, and the non-zero angle is about forty-five degrees.

7. A wood-type golf club head comprising:

a body comprising one or more walls defining an interior cavity and an exterior surface;

at least one weight port formed in the body, the at least one weight port opening to the exterior surface and configured to receive a weight; and at least one rib in the interior cavity of the body, the at least one rib secured to the at least one weight port and to at least one of the one or more walls, wherein a horizontal axis of the at least one rib forms a non-zero angle relative to a horizontal axis alone the face plate, and a height axis along the rib perpendicular to the horizontal axis along the rib is substantially parallel to a height axis along the face plate that is perpendicular to the horizontal axis along the face plate.

8. A wood-type golf club head comprising:

a body comprising one or more walls defining an interior cavity and an exterior surface;

at least one weight port formed in the body, the at least one weight port opening to the exterior surface and configured to receive a weight;

at least one rib in the interior cavity of the body, the at least one rib secured to the at least one weight port and to at least one of the one or more walls;

wherein the body comprises a face plate positioned at a forward portion of the golf club head, a sole positioned at a bottom portion of the golf club head, a crown positioned at a top portion of the golf club head, and a skirt positioned around a periphery of the golf club head between the sole and the crown; and a first weight port proximate a toe portion of the golf club head, and a second weight port proximate a heel portion of the golf club head; and a first rib secured to the first weight port and a second rib secured to the second weight port.

9. The golf club head of claim 8, further comprising a third rib extending between the first and second weight ports.

10. The golf club head of claim 8, wherein the first rib extends at least about 5 mm above the intersection between the first weight port and the first rib, and the second rib extends at least about 5 mm above the intersection between the second weight port and the second rib.

11. A golf club head comprising:

a body comprising one or more walls defining an interior cavity;

a plurality of weight ports each comprising a cantilevered portion at least partially within the cavity, wherein each cantilevered portion comprises a base mounted to at least one of the one or more walls, and the cantilevered portion extends a cantilevered length from the base; and one or more ribs each secured to the cantilevered portion of one of the weight ports and to another structural member of the golf club head, wherein at least one of the one or more ribs is secured to each of the weight ports.

12. The golf club head of claim 11, wherein the one or more ribs comprise a first rib that is secured to the cantilevered portion of a first weight port of the plurality of weight ports in a region extending to a point on the cantilevered portion of the first weight port that is at least about twenty percent of the cantilevered length from the base of the cantilevered portion of the first weight port.

13. The golf club head of claim 12, wherein the point is at least about eighty percent of the cantilevered length from the base.

14. The golf club head of claim 12, wherein the first rib extends along the cantilevered portion of the first weighted assembly from the base to the point.

15. The golf club head of claim 11, wherein the weight ports comprise first and second weight ports, and the one or more ribs comprise a rib extending from the first weight port to the second weight port.

16. The golf club head of claim 11, wherein the one or more walls comprise a face plate positioned at a forward portion of the golf club head, a sole positioned at a bottom portion of the golf club head, a crown positioned at a top portion of the golf club head, and a skirt positioned around a periphery of the golf club head between the sole and the crown.

17. A golf club head comprising:

a body comprising one or more walls defining an interior cavity and an exterior surface;

a plurality of cantilevered features in the interior cavity, wherein the plurality of cantilevered features each comprise a base mounted to at least one of the one or more walls of the interior cavity and a cantilevered portion extending a length from the base, the cantilevered portion protruding into the interior cavity to receive a weight and terminating inside the interior cavity; and one or more ribs secured to each cantilevered feature and to at least one wall of the interior cavity.

18. The golf club head of claim 17, wherein at least one of the plurality of cantilevered features comprises a weight port.

19. The golf club head of claim 18, wherein the weight port opens to the external surface of the body and is configured to receive a weight.

20. The golf club head of claim 17, wherein the one or more ribs comprise a first rib secured to the base of the cantilevered feature and extending about eighty percent of the cantilevered length along the cantilevered portion of the cantilevered feature.

21. The golf club head of claim 17, wherein the cantilevered features comprise first and second cantilevered features, and the one or more ribs comprise a rib extending from the first cantilevered feature to the second cantilevered feature.

22. The golf club head of claim 17, further comprising a plurality of ribs coupled to the cantilevered feature and configured in a substantially symmetrical configuration around an axis formed by the cantilevered feature.

* * * * *

UNITED STATES PATENT AND TRADEMARK OFFICE

CERTIFICATE OF CORRECTION

PATENT NO. : 7,713,142 B2
APPLICATION NO. : 12/011257
DATED : May 11, 2010
INVENTOR(S) : Joseph Henry Hoffman et al.

It is certified that error appears in the above-identified patent and that said Letters Patent is hereby corrected as shown below:

Column 14, line 15, "alone the face plate," should read --along the face plate,--.

Signed and Sealed this
Twentieth Day of March, 2012

David J. Kappos

David J. Kappos
*Director of the United States Patent and Trademark Office*